US010107580B2

(12) United States Patent
Fellows et al.

(10) Patent No.: US 10,107,580 B2
(45) Date of Patent: Oct. 23, 2018

(54) TRIGGER GROUP FOR SEMI-AUTOMATIC FIREARMS

(71) Applicant: Franklin Armory Holdings, Inc., Minden, NV (US)

(72) Inventors: Ryan Paul Fellows, San Jose, CA (US); Jay Leonard Jacobson, Minden, NV (US)

(73) Assignee: FRANKLIN ARMORY HOLDINGS, INC., Minden, NV (US)

( * ) Notice: Subject to any disclaimer, the term of this patent is extended or adjusted under 35 U.S.C. 154(b) by 0 days.

(21) Appl. No.: 15/290,980

(22) Filed: Oct. 11, 2016

(65) Prior Publication Data

US 2017/0299309 A1 Oct. 19, 2017

Related U.S. Application Data

(60) Provisional application No. 62/240,479, filed on Oct. 12, 2015.

(51) Int. Cl.
*F41A 19/45* (2006.01)
*F41A 19/43* (2006.01)

(52) U.S. Cl.
CPC ..... *F41A 19/43* (2013.01); *F41A 19/45* (2013.01)

(58) Field of Classification Search
CPC ..... F41A 19/43; F41A 19/24; F41A 19/44; F41A 19/46; F41A 19/45; F41A 19/12; F41A 19/10; F41A 19/06; F41A 19/74
USPC ..... 89/129.01, 129.02, 132, 136, 140, 125; 42/69.03
See application file for complete search history.

(56) References Cited

U.S. PATENT DOCUMENTS

| | | | | |
|---|---|---|---|---|
| 2,027,950 A | | 1/1936 | Young | |
| 2,136,511 A | * | 11/1938 | Jones | F41A 19/24 42/69.01 |
| 6,125,735 A | * | 10/2000 | Guhring | F41A 19/02 42/69.03 |
| 6,966,138 B1 | * | 11/2005 | Deckard | F41A 19/24 42/69.01 |
| 8,667,881 B1 | * | 3/2014 | Hawbaker | F41A 19/46 42/69.01 |
| 8,820,211 B1 | * | 9/2014 | Hawbaker | F41A 19/46 42/69.01 |
| 9,146,066 B1 | * | 9/2015 | Cason | F41A 19/09 |
| 2016/0018176 A1 | * | 1/2016 | Fellows | F41A 19/02 42/69.03 |

(Continued)

*Primary Examiner* — John Cooper
(74) *Attorney, Agent, or Firm* — Bennet K. Langlotz; Langlotz Patent & Trademark Works, Inc.

(57) ABSTRACT

Trigger groups for semi-automatic firearms have a frame, a hammer connected to the frame and movable between a cocked position and a striking position, the hammer being biased toward the striking position, a trigger element connected to the frame and movable by a user between a forward position and a rearward position, a selector connected to the frame and movable between at least a first position and a second position, a plurality of retention facilities each operable to selectively restrain the hammer in the cocked position, and when the selector is in the first position to enable discharge of the firearm in response to movement of the trigger to the rearward position, and when the selector is in the second position to enable discharge of the firearm in response to movement of the trigger to the forward position after movement to the rearward position.

18 Claims, 14 Drawing Sheets

(56) References Cited

U.S. PATENT DOCUMENTS

2017/0122686 A1* 5/2017 Fellows ..... F41A 19/24

* cited by examiner

TRIGGER GROUP FOR SEMI-AUTOMATIC FIREARMS

CROSS-REFERENCE TO RELATED APPLICATION

This application claims the benefit of U.S. Provisional Patent Application No. 62/240,479 filed on Oct. 12, 2015, entitled "RELEASE FIRING SYSTEM™ (aka RFS™)," which is hereby incorporated by reference in its entirety for all that is taught and disclosed therein.

FIELD OF THE INVENTION

The present invention relates to firearms, and more particularly to a trigger group for semi-automatic firearms.

BACKGROUND OF THE INVENTION

A trigger group includes all parts of the firearm that initiate the firing of the bullet. Parts include the trigger, which is usually a lever that is tripped by one or more fingers of the firing hand; the sear, which holds the hammer back until the trigger has been pulled; a disconnector, which keeps the hammer in place until the trigger is released and the sear takes over after a cycle of semi-automatic fire has occurred; and several springs throughout the group. The sear may be a separate part or can be a surface incorporated into the trigger. As the trigger is pulled, the sear slips, allowing the hammer to strike the firing pin to discharge a round.

A release trigger releases the hammer or striker when the trigger is released by the shooter rather than when it is pulled, thereby firing a round not when the trigger is pulled, but upon trigger release. An existing approach to a trigger system that does not fire with trigger pull and fires one round with trigger release is disclosed in U.S. Pat. No. 2,027,950 to Young. Young's trigger system, and release triggers generally, are largely used on shotguns intended for trap and skeet shooting. However, Young's trigger system suffers from multiple disadvantages. First, there is no way to change the mode of firing from release trigger to standard semi-automatic firing. Second, there is no provision for using Young's trigger system in other popular weapons systems, such as the AR-15, M-16, and AR-10 platforms.

U.S. Pat. Nos. 8,820,211 and 8,667,881 to Hawbaker disclose a trigger system with a selector that allows the user to choose between two modes and rates of fire. One mode is firing one round with a trigger pull and resetting with trigger release, and the second mode is firing one round with trigger pull, and firing a second round with trigger release. Hawbaker's trigger must be pulled fully rearward or released fully forward to operate and utilizes two disconnectors. Hawbaker has the disadvantage of requiring two selectors with two positions each (a safety selector and a mode selector), with the mode selector being located on the trigger. The location of the mode selector on the trigger is particularly disadvantageous since the setting of the mode selector could be unintentionally changed by the user while reaching for the trigger.

Therefore, a need exists for a new and improved trigger group for semi-automatic firearms that enables the firearm to switch between safe, semi-automatic, and release trigger modes. In this regard, the various embodiments of the present invention substantially fulfill at least some of these needs. In this respect, the trigger group for semi-automatic firearms according to the present invention substantially departs from the conventional concepts and designs of the prior art, and in doing so provides an apparatus primarily developed for the purpose of providing a trigger group for semi-automatic firearms that enables the firearm to switch between safe, semi-automatic, and release trigger modes.

SUMMARY OF THE INVENTION

The present invention provides an improved trigger group for semi-automatic firearms, and overcomes the above-mentioned disadvantages and drawbacks of the prior art. As such, the general purpose of the present invention, which will be described subsequently in greater detail, is to provide an improved trigger group for semi-automatic firearms that has all the advantages of the prior art mentioned above.

To attain this, the preferred embodiment of the present invention essentially comprises a frame, a hammer connected to the frame and movable between a cocked position and a striking position, the hammer being biased toward the striking position, a trigger element connected to the frame and movable by a user between a forward position and a rearward position, a selector connected to the frame and movable between at least a first position and a second position, a plurality of retention facilities each operable to selectively restrain the hammer in the cocked position, and when the selector is in the first position to enable discharge of the firearm in response to movement of the trigger to the rearward position, and when the selector is in the second position to enable discharge of the firearm in response to movement of the trigger to the forward position after movement to the rearward position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
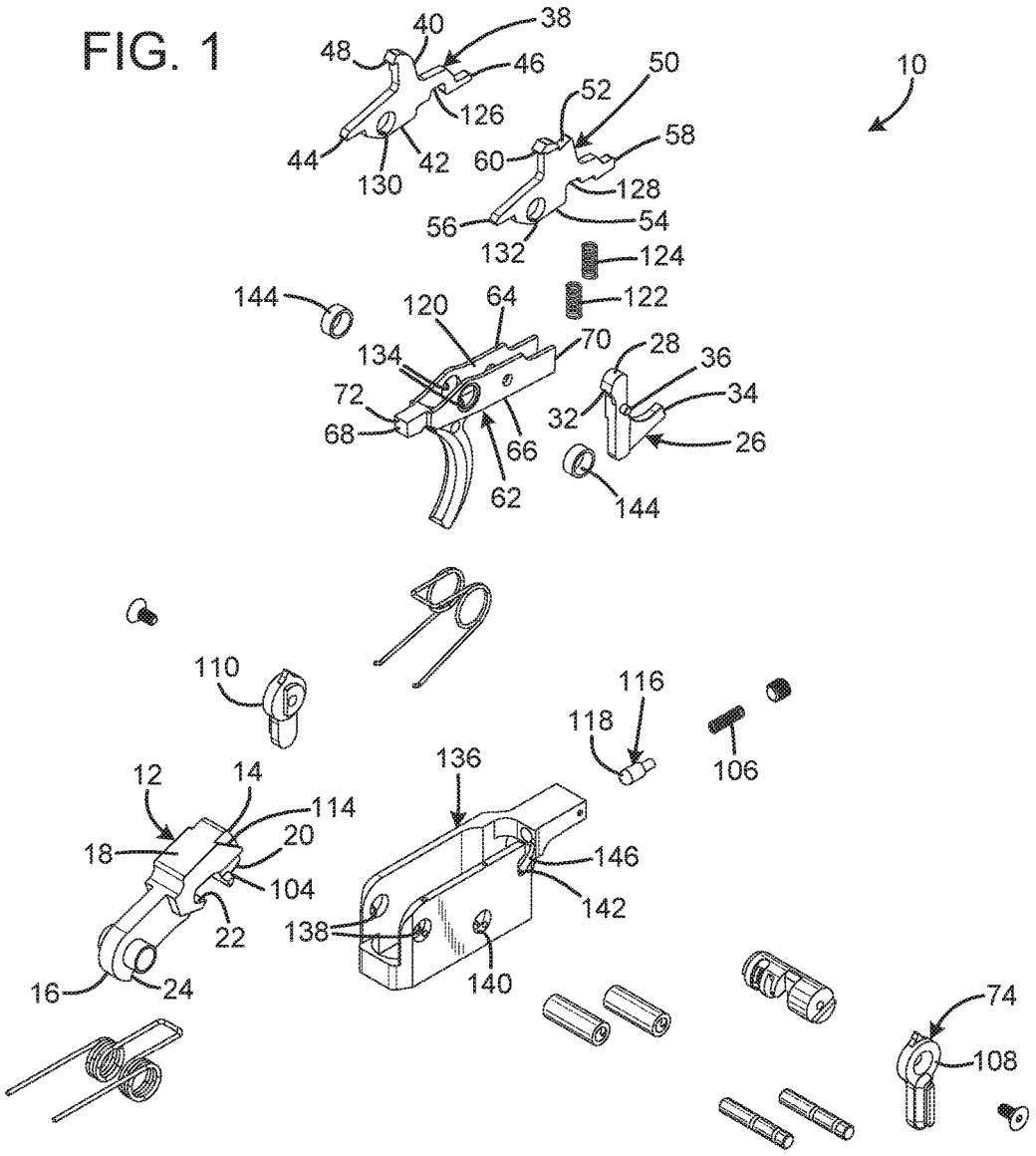
FIG. 1 is an exploded view of the current embodiment of the trigger group for semi-automatic firearms constructed in accordance with the principles of the present invention.

An embodiment of the trigger group for semi-automatic firearms of the present invention is shown and generally designated by the reference numeral 10.

FIG. 1 illustrates the improved trigger group for semi-automatic firearms 10 of the present invention. More particularly, the trigger group for semi-automatic firearms 10 has a hammer 12, backup disconnector 26, release disconnector 38, semi-automatic disconnector 50, trigger 62, and safety selector assembly 74. When assembled, the hammer, backup disconnector, release disconnector, semi-automatic disconnector, trigger, and safety selector are connected to a housing 136. Each side of the housing has a front aperture 138, a central aperture 140, and a rear aperture 142. A portion of the housing adjacent to the left rear aperture defines a cam surface 146. The apertures receive cross-pins (unlabeled) that are received within axles (unlabeled), which are cylinders with a thru-hole. The cross-pins hold the trigger group for semi-automatic firearms 10 within the lower of the firearm (not shown). The axles fit through apertures in the hammer, hammer spring (unlabeled), trigger, trigger spring (unlabeled), trigger spacers 144, and the housing. The trigger spacers are on the same level as the trigger, and keep the trigger from sliding laterally within the housing.

The hammer has a top 14, bottom 16, front 18, and rear 20. The top rear of the hammer defines a curved notch 22, and the bottom rear of the hammer defines a hammer sear surface 24. The hammer also includes a leftward protruding ridge 104 directly above the notch 22. A relief area 114 is present above the ridge. The relief area is an optional feature depending upon the thickness of the hammer to provide clearance for the backup disconnector. The backup disconnector has a top 28, bottom 30, front hook 32, and rear 34. The backup disconnector includes a leftward protruding cam pin 36 located below the front hook. The cam pin protrudes through the left rear aperture of the housing and interacts with the cam surface 146. A backup disconnector biasing pin 116 has a tip 118 that is urged forward against the rear of the backup disconnector by a spring 106.

The release disconnector 38 has a top 40, bottom 42, front 44, rear 46, and central aperture 130. The top of the release disconnector includes a forward facing hook 48, and the bottom rear defines a notch 126. The semi-automatic disconnector has a top 52, bottom 54, front 56, rear 58, and central aperture 132. The top of the semi-automatic disconnector includes a forward facing hook 60, and the bottom rear defines a notch 128. The trigger 62 has a top 64, bottom 66, front 68, rear 70, and central apertures 134. The top of the front of the trigger includes a sear 72. The release disconnector 38 and semi-automatic disconnector 50 are each planar elements parallel to and adjacent to each other that fit in a channel 120 along the top spine of the trigger 62. In the current embodiment, the safety selector assembly 74 is ambidextrous, with the lever on the left 108 being larger than the lever on the right 110. The safety selector is swappable, which enables the user to place the larger lever on the desired side of the firearm. The release disconnector, semi-automatic disconnector, backup disconnector, and sear all act as retention facilities each operable to selectively restrain the hammer in the cocked position. The trigger group for semi-automatic firearms 10 is suitable for use with an AR-15 rifle in the current embodiment.

Figure 2:
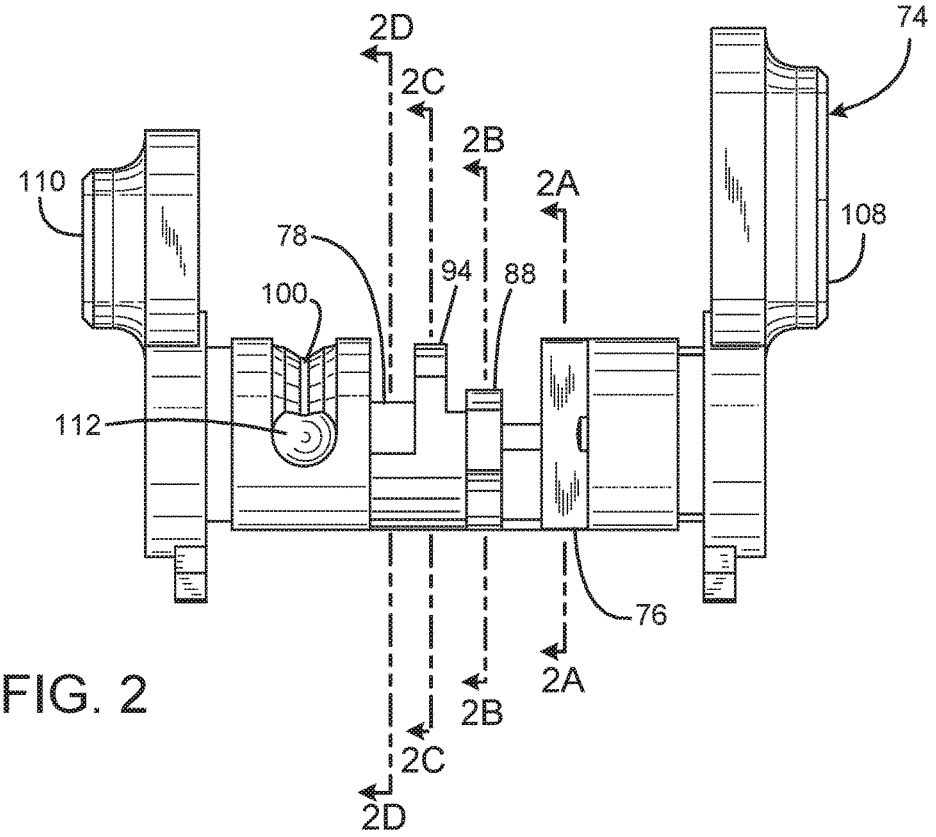
FIG. 2 is a top view of the safety selector of FIG. 1.
Figure 2A:
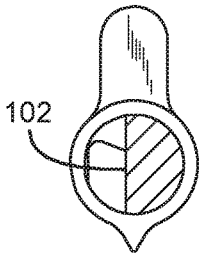
FIG. 2A is a sectional view of the safety selector taken along line 2A-2A of FIG. 2.
Figure 2B:
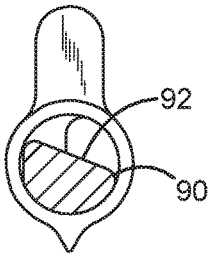
FIG. 2B is a sectional view of the safety selector taken along line 2B-2B of FIG. 2.
Figure 2C:
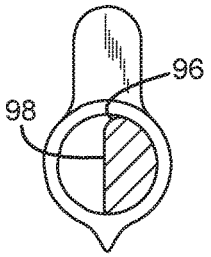
FIG. 2C is a sectional view of the safety selector taken along line 2C-2C of FIG. 2.
Figure 2D:
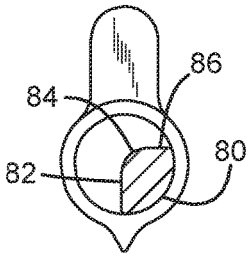
FIG. 2D is a sectional view of the safety selector taken along line 2D-2D of FIG. 2.

FIGS. 2-2D illustrate the improved safety selector assembly 74 of the present invention. More particularly, the safety selector provides the user of an associated firearm with three distinct modes: safe mode, semi-automatic mode, and release mode. The safety selector has five cam lobe profiles 76, 78, 88, 94, 106 and a safety detent trough 100 extending from left 108 to right 110. Cam lobe 76 regulates the movement of the backup disconnector 26. Cam lobe 78 regulates the movement of the trigger 62. Cam lobe 88 regulates the movement of the semi-automatic disconnector 50. Cam lobe 94 regulates the movement of the release disconnector 38.

The backup disconnector cam 76 has a section 102 of the cam lobe that engages the protrusion 36 on the backup disconnector 26 to manipulate the backup disconnector. The trigger relief and safety cam 78 has a full diameter section 80 that limits trigger 62 travel to prevent firing in safe mode, a trigger relief cut 82 to enable release mode firing, a rounded edge 84 to provide a smooth transition between firing modes, and a trigger relief cut 86 to enable semi-automatic firing. The semi-automatic disconnector cam 88 has a cam lobe portion 90 that limits semi-automatic disconnector 50 travel when engaged, and a relief 92 that allows the semi-automatic disconnector to fully articulate. The release disconnector cam 94 has a cam lobe portion 96 that limits release disconnector 38 travel when engaged and a relief 98 that allows the release disconnector to fully articulate.

The safety detent trough 100 located on the far right side 110 of the safety selector is a shallow groove with three plunge cuts 112 spaced 90° apart. A spring-loaded safety detent (not shown) has a tip that travels in this groove and stops at each plunge cut. This feature defines the three separate modes noted above. When additional finger pressure is applied to the safety selector lever, the safety detent spring is overridden, and the safety selector travels to the next plunge cut that defines the next mode.

Figure 3:
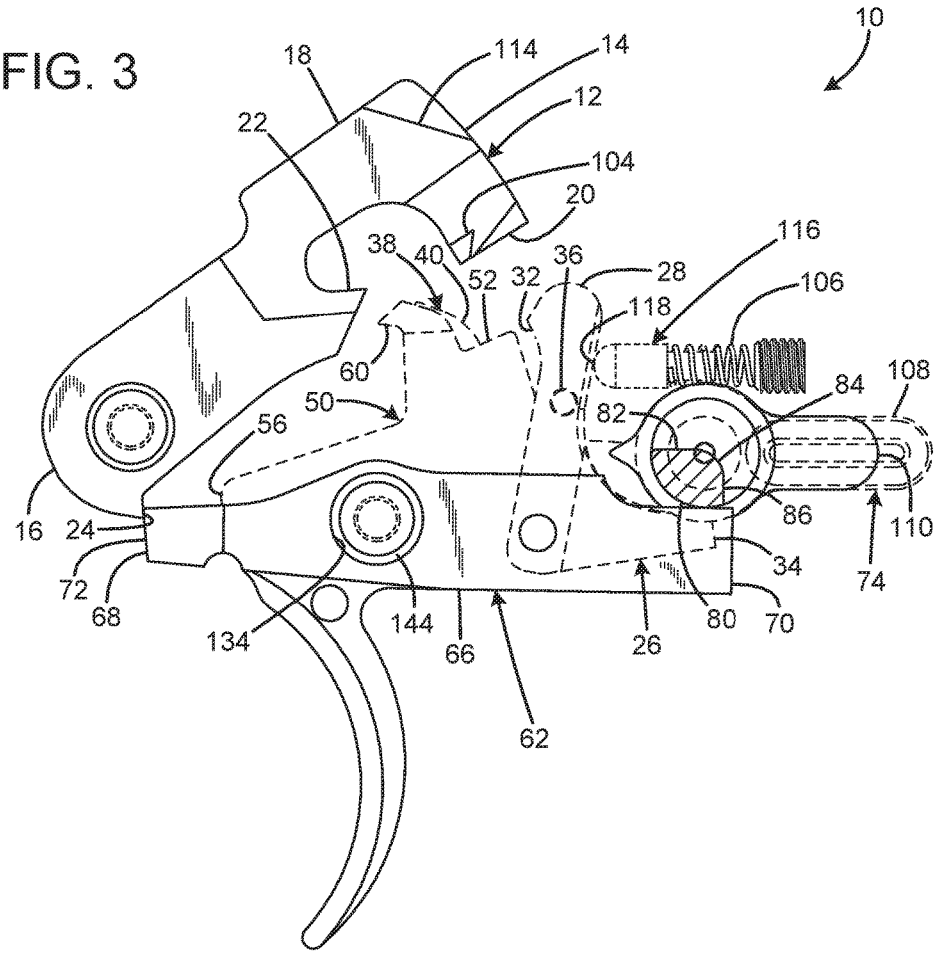
FIG. 3 is a left side sectional view of the trigger group for semi-automatic firearms of FIG. 1 with the safety selector in safe mode and the trigger pulled rearward until stopped by the selector shaft.

FIG. 3 illustrates the improved trigger group for semi-automatic firearms 10 of the present invention. More particularly, the trigger group for semi-automatic firearms 10 is shown in safe mode with the safety selector assembly 74 pointing at the 9 o'clock position. The trigger is physically prevented from being pulled because cam lobe 78 on the safety selector assembly 74 is restricting the rearward section 70 of the trigger from moving upward. Since the trigger is immobilized, the hammer 12 is restricted from rotating forward under spring pressure because the sear 72 on the front 68 edge of the trigger is caught on notch 24 of the hammer. In addition, cam lobe 76 on the safety selector restricts the rear 34 of the backup disconnector 26 from rising.

Figure 4:
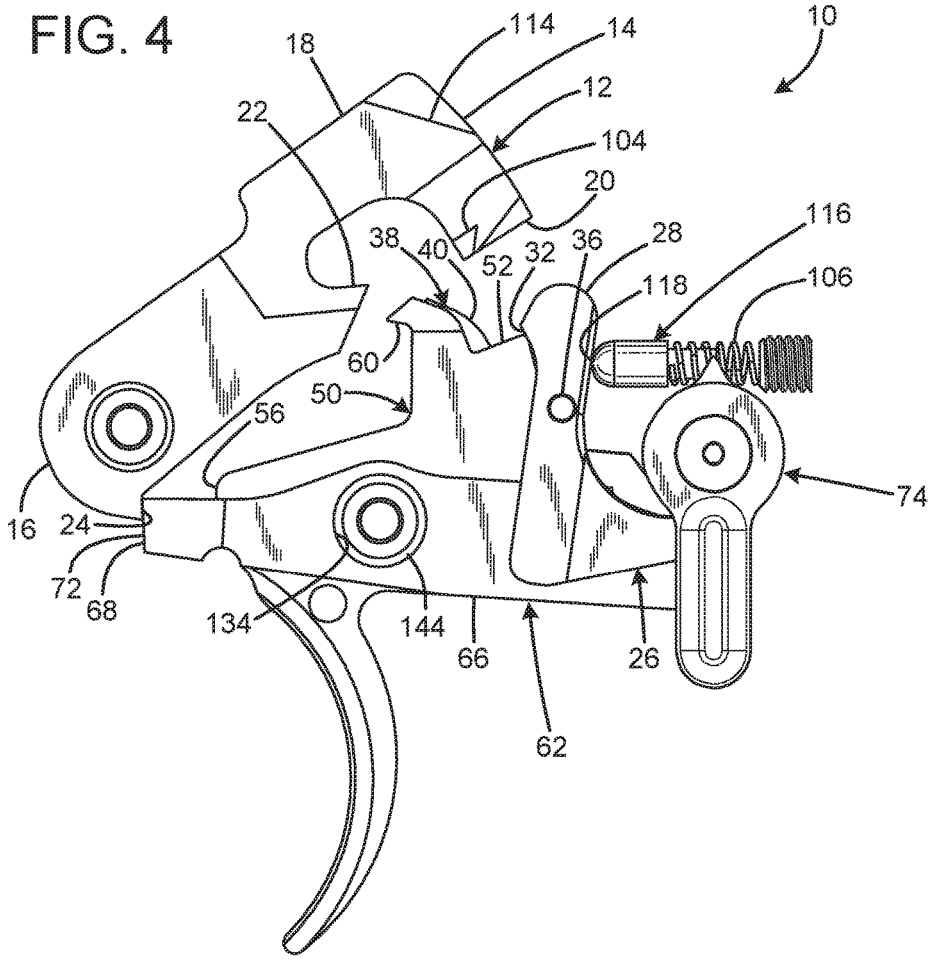
FIG. 4 is a left side view of the trigger group for semi-automatic firearms of FIG. 1 with the safety selector in semi-automatic mode and the trigger at rest.

FIG. 4 illustrates the improved trigger group for semi-automatic firearms 10 of the present invention. More particularly, the trigger group for semi-automatic firearms 10 is shown in semi-automatic mode with the safety selector assembly 74 pointing at the 12 o'clock position. In this mode, cam lobe 78 on the safety selector assembly 74 is recessed to allow the trigger 62 to be pulled when the hammer 12 is cocked. Cam lobe 88 on the safety selector is also recessed to allow the rear 58 of the semi-automatic disconnector 50 to rotate counterclockwise under spring pressure so the hook 60 on the semi-automatic disconnector is able to come into contact with the notch 22 on the hammer. The cam lobe 94 is pushing down on the release disconnector 38 to prevent the rear 46 from rotating counterclockwise under spring pressure so the hook 48 on the release disconnector is able to interface with the hammer. Cam lobe 76 on the safety selector restricts the rear 34 of the backup disconnector 26 from rising. If the trigger is pulled in this mode, the hammer will rotate forward under spring pressure and hit the firing pin (not shown) to discharge a round.

Figure 5:
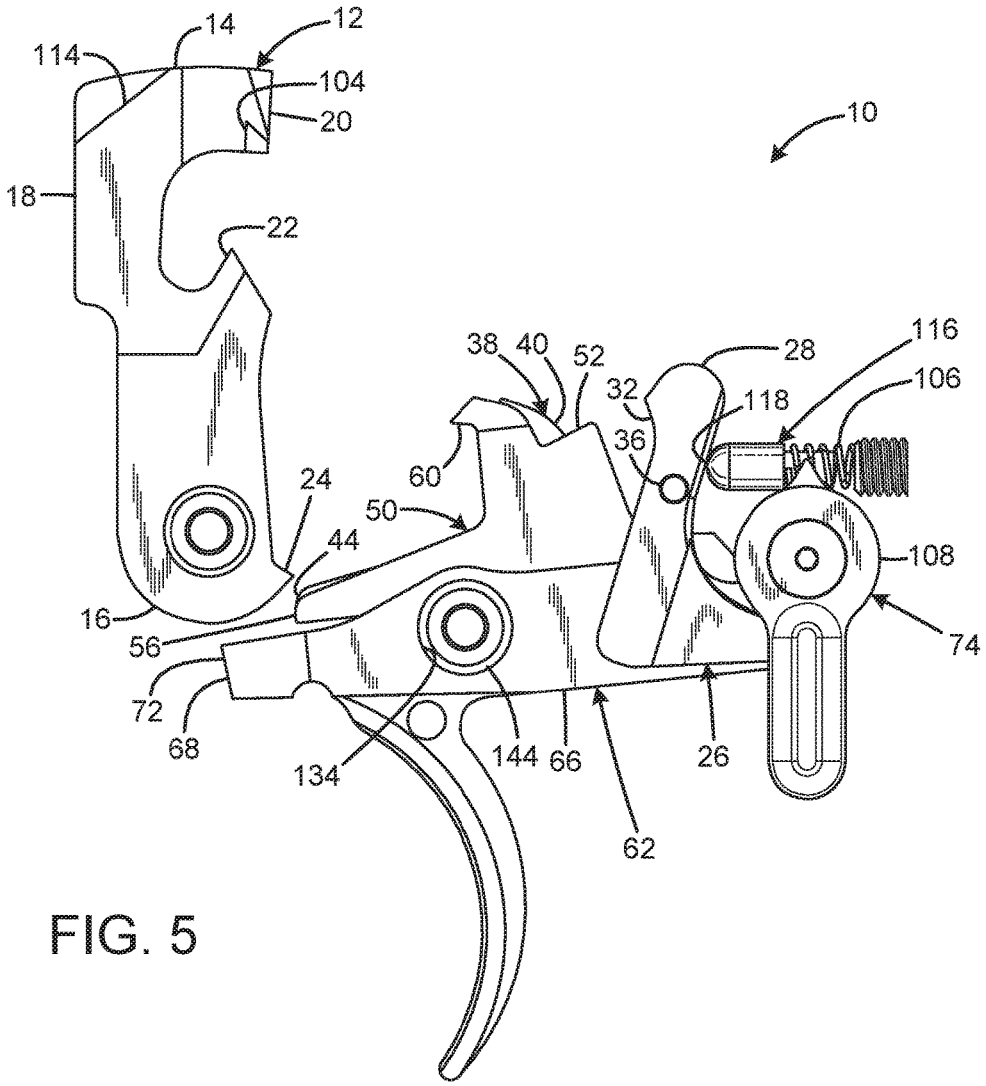
FIG. 5 is a left side view of the trigger group for semi-automatic firearms of FIG. 1 at the moment of firearm discharge with the safety selector in semi-automatic mode.

FIG. 5 illustrates the improved trigger group for semi-automatic firearms 10 of the present invention. More particularly, the trigger group for semi-automatic firearms 10 is shown in semi-automatic mode with the safety selector assembly 74 pointing at the 12 o'clock position. The trigger 62 has been pulled rearward until the trigger is stopped by the safety selector, which has disengaged the sear 72 from the notch 24 on the hammer. The disengagement has enabled the hammer 12 to rotate forward under spring pressure to hit the firing pin to discharge a round. The semi-automatic disconnector 50 is rotated counterclockwise relative to the release disconnector 38. In this position, the hook 60 on the semi-automatic disconnector is positioned in front of the hook 48 on the release disconnector.

Figure 6:
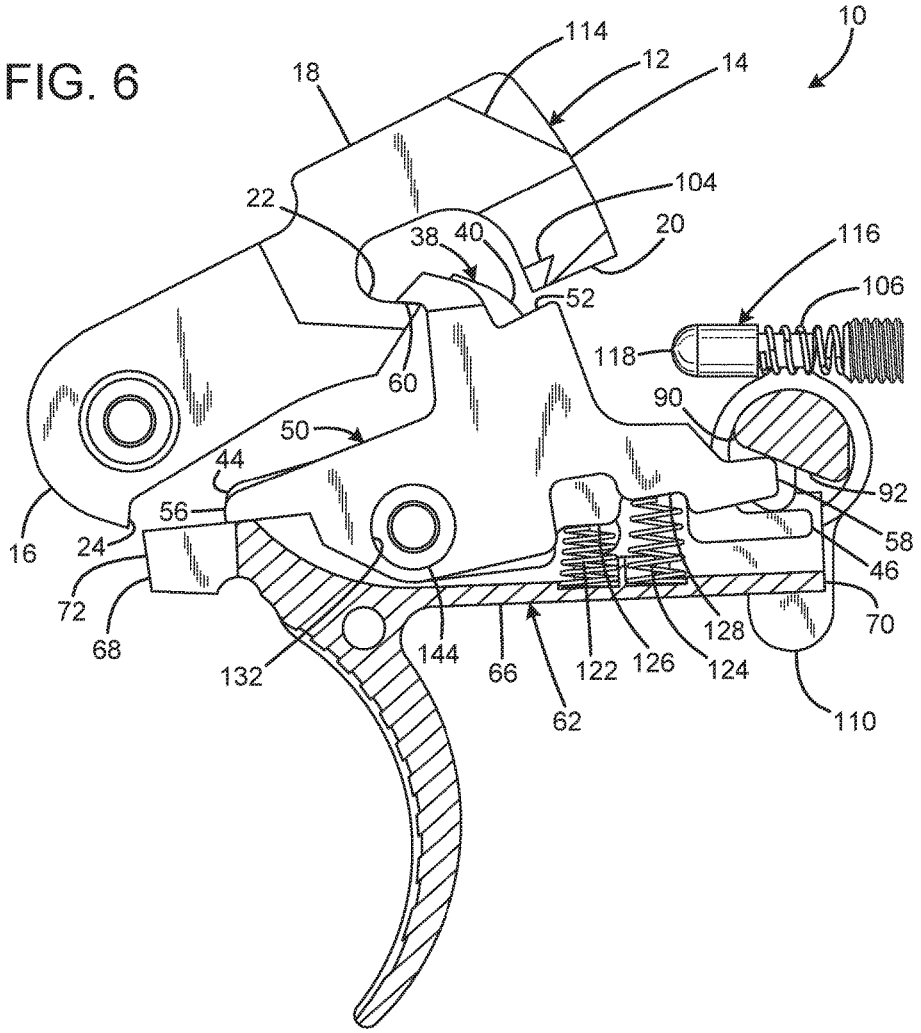
FIG. 6 is a left side sectional view of the trigger group for semi-automatic firearms of FIG. 1 after the firearm has been re-cocked with the trigger pulled when the safety selector is in semi-automatic mode.

FIG. 6 illustrates the improved trigger group for semi-automatic firearms 10 of the present invention. More particularly, the trigger group for semi-automatic firearms 10 is shown in semi-automatic mode with the safety selector assembly 74 pointing at the 12 o'clock position. Gas pressure resulting from the discharge of a round has driven the bolt carrier group 148 (shown in FIG. 8) rearward, pushing the hammer 12 back into the cocked position. The notch 22 of the hammer has latched onto the hook 60 of the semi-automatic disconnector 50. This engagement prevents the hammer from rotating forward again even though the trigger 62 remains pulled. The hook 48 on the release disconnector 38 is held behind the hook on the semi-automatic disconnector, which prevents the hook on the release disconnector from engaging the notch 22 on the hammer. As the trigger is released, the front 56 of the semi-automatic disconnector is pushed up. This movement disengages the notch 22 of the hammer from the hook 60 of the semi-automatic disconnector. Just prior to the hammer disengaging from the semi-automatic disconnector, the sear 72 on the trigger 62 is positioned to catch the notch 24 in the hammer, which prevents the hammer from rotating forward until the trigger is pulled again. This is the position shown in FIG. 4.

Figure 7:
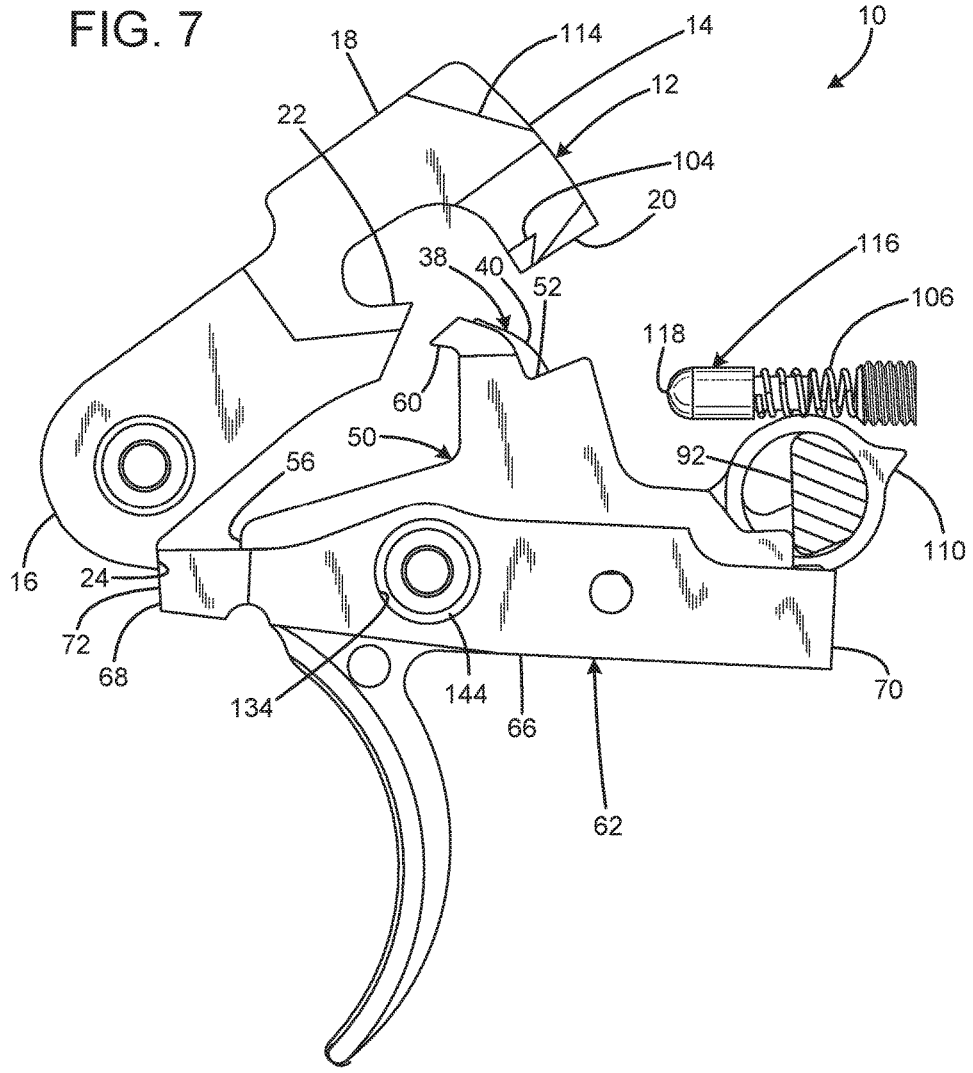
FIG. 7 is a left side sectional view of the trigger group for semi-automatic firearms of FIG. 1 with the safety selector prevented from transitioning from semi-automatic mode to release mode with the trigger at rest.
Figure 8:
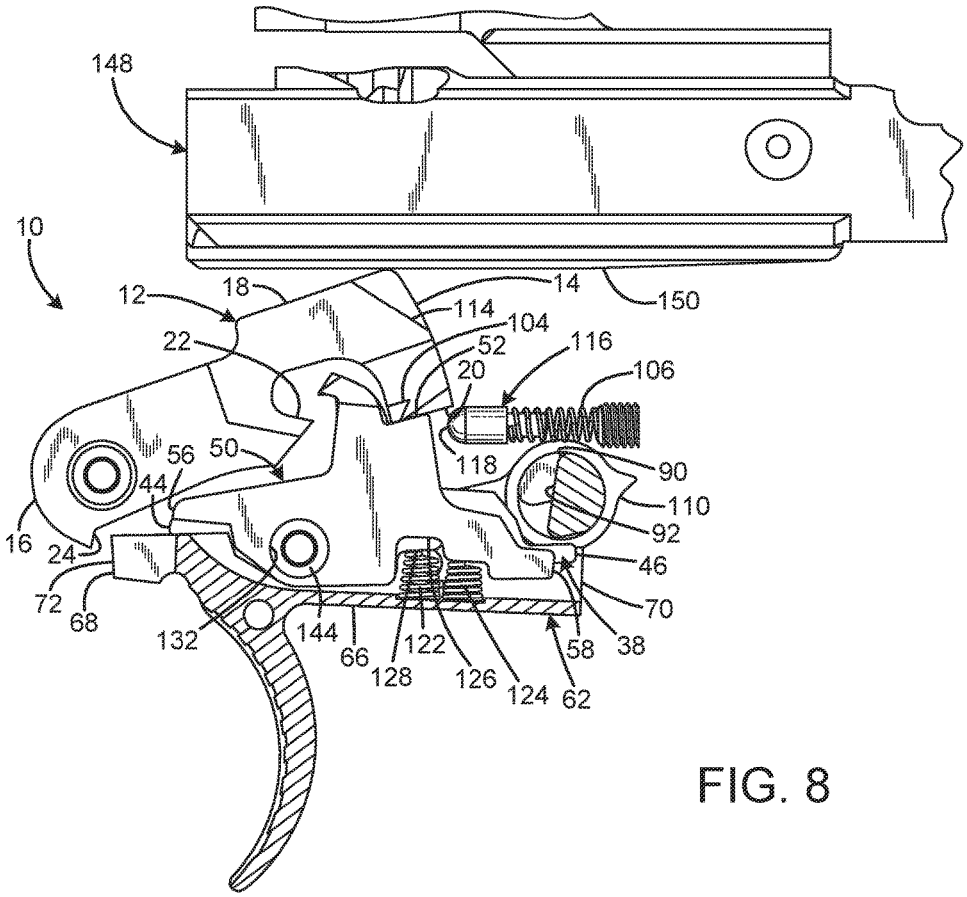
FIG. 8 is a left side sectional view of the trigger group for semi-automatic firearms of FIG. 1 with the safety selector in transition from semi-automatic mode to release mode with the trigger released and the bolt carrier group back.

FIGS. 7 and 8 illustrate the improved trigger group for semi-automatic firearms 10 of the present invention. More particularly, the trigger group for semi-automatic firearms 10 is shown failing to transition from semi-automatic mode to release mode in FIG. 7, and succeeding in transitioning from semi-automatic mode to release mode in FIG. 8. The safety selector assembly 74 cannot transition from semi-automatic mode to release mode unless the bolt carrier group 148 (shown in FIG. 8) is locked back and the trigger 62 is forward. Otherwise, the rear 58 of the semi-automatic disconnector 50 blocks cam lobe 92 on the safety selector and prevents further clockwise rotation of the safety selector into release mode. The backup disconnector 26 is also blocked, but by the interaction between the cam pin 36 and the cam surface 146 on the housing 136 rather than by an interaction with the safety selector. This safety feature prevents users from inadvertently shifting the safety selector to release mode unless the user clearly intends to do so. This safety feature also prevents users from switching into release mode while the notch 24 of the hammer 12 is on the sear 72 of the trigger. Otherwise, the user could fire a shot on the first trigger pull in release mode as well as firing an additional shot upon trigger release.

When the bolt carrier group 148 is locked back and the trigger 62 is forward, the bottom 150 of the bolt carrier group depresses the top 14 of the hammer into a maximum compressed state. Depression means moving the hammer beyond the cocked position, further away from the firing position. The rear 20 of the hammer simultaneously depresses the top 64 of the semi-automatic disconnector 50, thereby pushing the rear 58 of the semi-automatic disconnector downward out of the path of the cam lobe 88 on the safety selector assembly 74. The user can then rotate the safety selector clockwise into release mode with the safety selector pointing at the 3 o'clock position.

Figure 9:
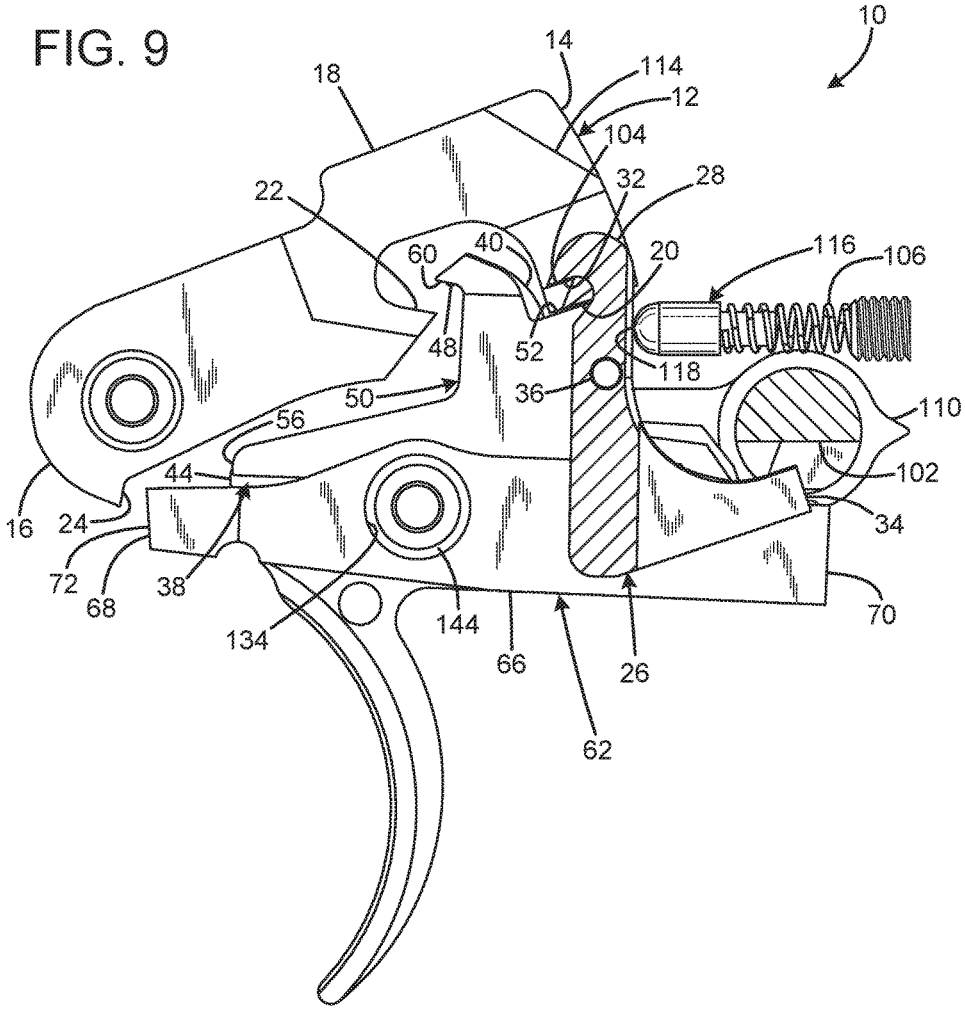
FIG. 9 is a left side sectional view of the trigger group for semi-automatic firearms of FIG. 1 with the hammer held by the backup disconnector and the trigger at rest when the safety selector is in release mode.

FIG. 9 illustrates the improved trigger group for semi-automatic firearms 10 of the present invention. More particularly, the trigger group for semi-automatic firearms 10 is shown in release mode with the safety selector assembly 74 pointing at the 3 o'clock position. After the user selects release mode, the bolt carrier group 148 may be allowed to travel forward because the front hook 32 of the backup disconnector 26 has previously hooked on the ridge 104 on the hammer 12. The trigger 62 is shown at rest in the forward position.

Figure 10:
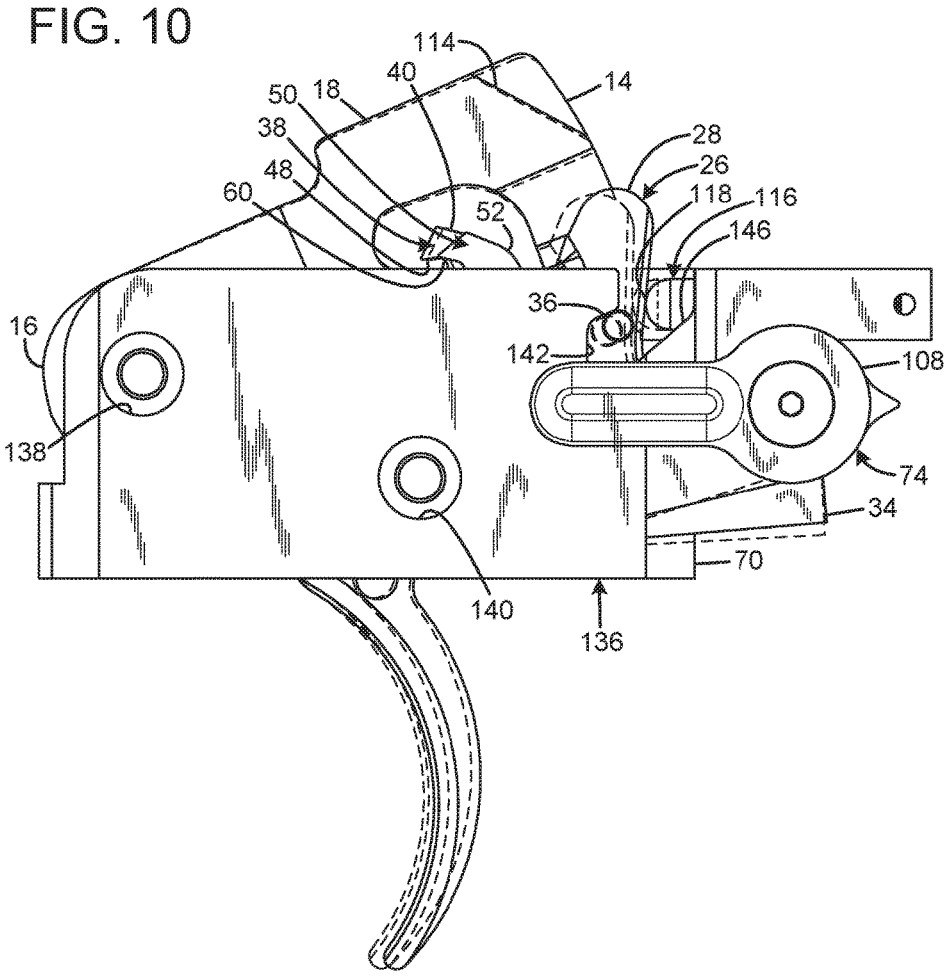
FIG. 10 is a left side view of the trigger group for semi-automatic firearms of FIG. 1 with the safety selector in release mode and the trigger pulled to the moment of hammer release.

FIG. 10 illustrates the improved trigger group for semi-automatic firearms 10 of the present invention. More particularly, the trigger group for semi-automatic firearms 10 is shown in release mode with the safety selector assembly 74 pointing at the 3 o'clock position. In this mode, cam lobe 78 on the safety selector assembly 74 is recessed to allow the trigger 62 to be pulled when the hammer 12 is cocked. As the user pulls the trigger 62 rearward in release mode, the cam pin 36 on the backup disconnector 26 cams on the cam surface 146 on the housing 136, thereby pushing the backup disconnector upward and rearward simultaneously. Once the trigger is pulled sufficiently rearward, the front hook 32 on the backup disconnector disengages from the ridge 104 on the hammer 12 and releases the hammer.

Figure 11:
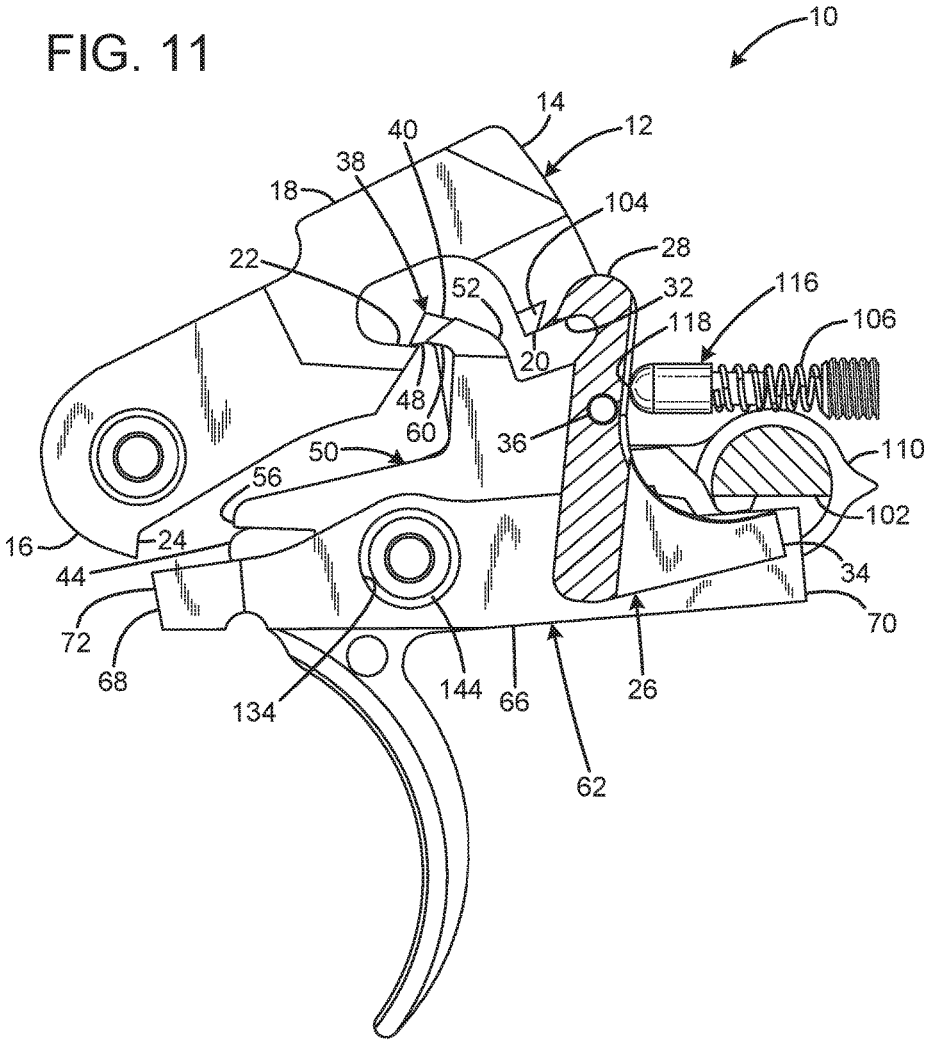
FIG. 11 is a left side sectional view of the trigger group for semi-automatic firearms of FIG. 1 with the safety selector in release mode and the hammer caught by the release disconnector.

FIG. 11 illustrates the improved trigger group for semi-automatic firearms 10 of the present invention. More particularly, the trigger group for semi-automatic firearms 10 is shown in release mode with the safety selector assembly 74 pointing at the 3 o'clock position. Cam lobe 94 on the safety selector is recessed to allow the rear 46 of the release disconnector 38 to rotate counterclockwise under spring pressure so the hook 48 on the release disconnector is able to come into contact with the notch 22 on the hammer. Before the hammer 12 can travel all the way to the firing pin after being released by the backup disconnector 26, the hook 48 on the release disconnector engages with the notch 22 on the hammer. The release disconnector restrains the hammer until the user relaxes the trigger 62 sufficiently that the release disconnector releases the hammer.

Figure 12:
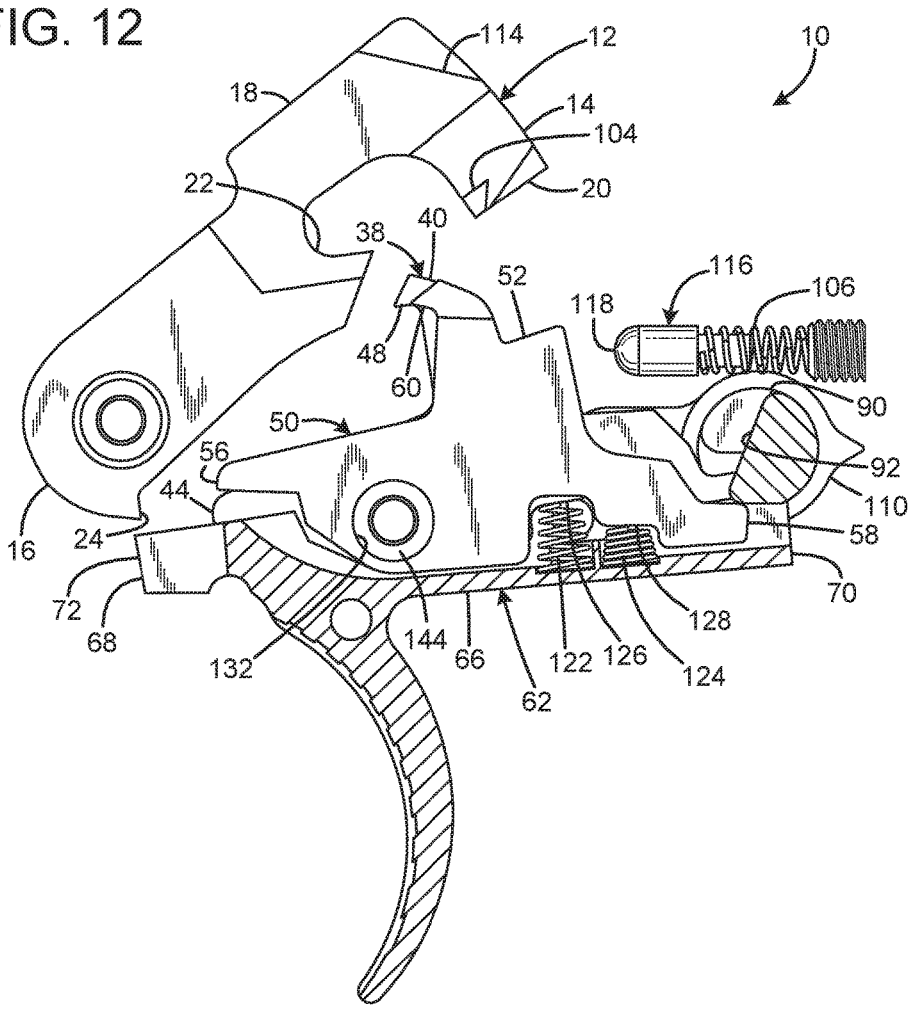
FIG. 12 is a left side sectional view of the trigger group for semi-automatic firearms of FIG. 1 with the safety selector in release mode and the trigger relaxed sufficiently to disengage the hammer from the release disconnector.

FIG. 12 illustrates the improved trigger group for semi-automatic firearms 10 of the present invention. More particularly, the trigger group for semi-automatic firearms 10 is shown in release mode with the safety selector assembly 74 pointing at the 3 o'clock position. The cam lobe 88 pushes the rear 58 of the semi-automatic disconnector 50 downwards so the hook 60 on the semi-automatic disconnector is pulled rearward and is unable to interface with the hammer. If the trigger is released in this mode, the hammer will rotate forward under spring pressure and hit the firing pin (not shown) to discharge a round. In FIG. 12, the user has relaxed the trigger 62 sufficiently that the hook 48 of the release disconnector 38 has released the hammer 12. The hammer is then free to swing unimpeded to the firing pin to discharge a round because the sear 72 on the trigger is not far enough forward to engage the notch 24 on the hammer, and the hook 60 on the semi-automatic disconnector 50 cannot reach the notch 22 on the hammer.

Figure 13:
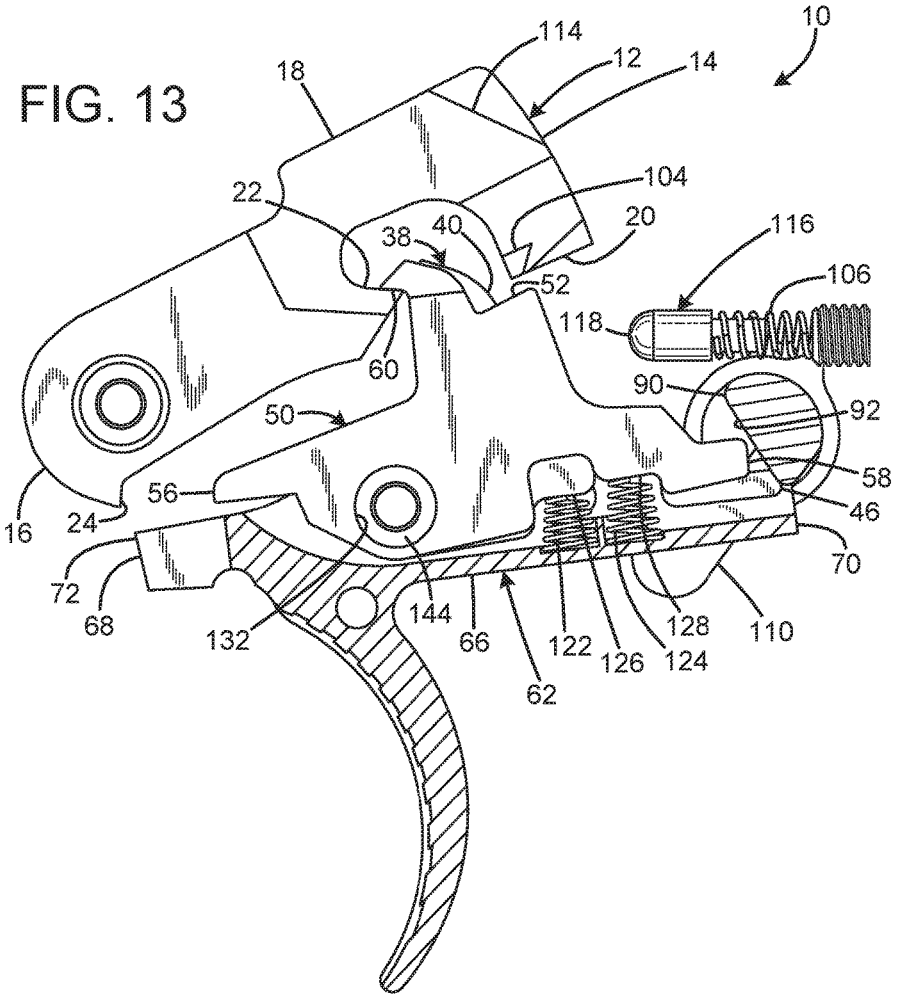
FIG. 13 is a left side sectional view of the trigger group for semi-automatic firearms of FIG. 1 with the safety selector in transition from release mode to semi-automatic mode to cancel the release shot.
Figure 14:
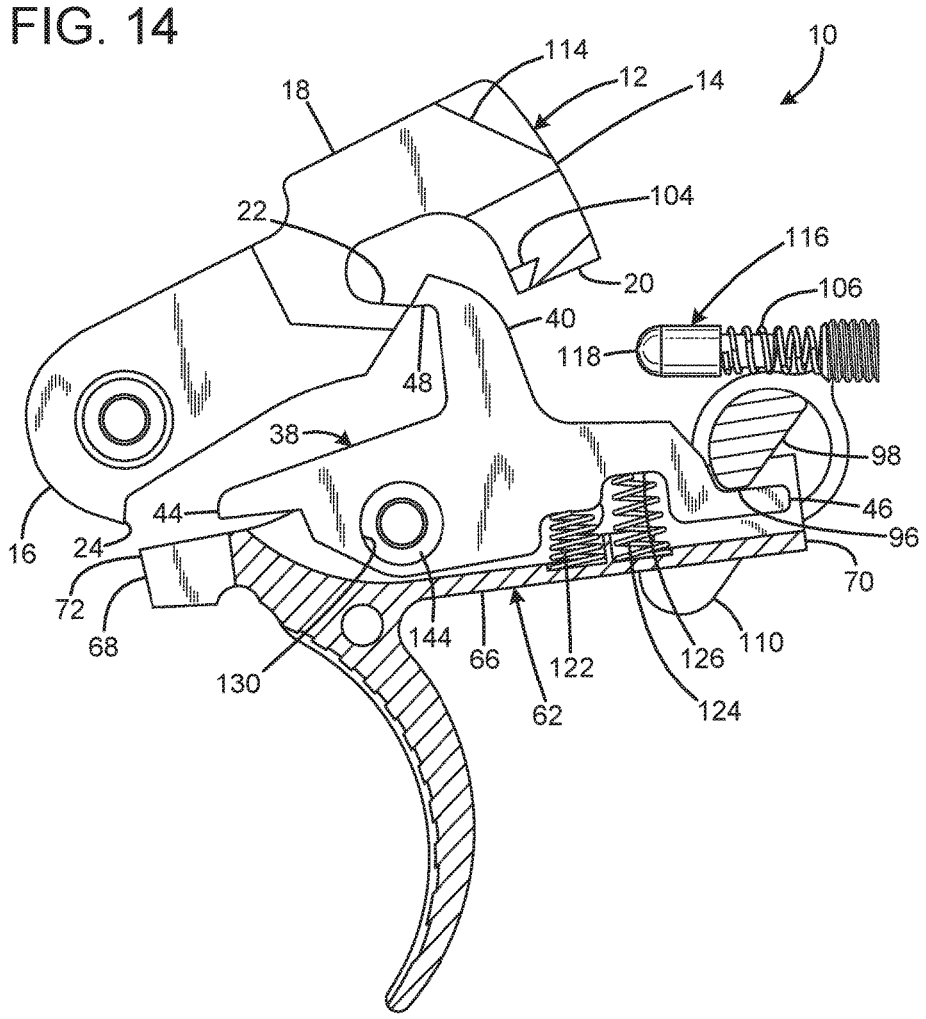
FIG. 14 is a left side sectional view of the trigger group for semi-automatic firearms of FIG. 1 with the safety selector in transition from release mode to semi-automatic mode to cancel the release shot.

FIGS. 13 and 14 illustrate the improved trigger group for semi-automatic firearms 10 of the present invention. More particularly, the trigger group for semi-automatic firearms 10 is shown transitioning from release mode to semi-automatic mode with the safety selector assembly 74 pointing at the 3 o'clock position. The user has the ability to transition from release mode to semi-automatic mode even after having pulled the trigger 62 in release mode. This is an important safety feature because it enables the user to cancel the firing of a release shot in release mode instead of requiring the user to first fire a release shot in release mode if the trigger has been pulled before transitioning from release mode to semi-automatic mode. If desired, the user can continue to rotate the safety selector counterclockwise to return the firearm to safe mode. This can be accomplished even if the firearm is initially in release mode with the trigger held back waiting to fire a round upon trigger release. The user can manipulate the selector to return the firearm to safe mode while holding the trigger back without discharging the round. This is an incredibly important capability since persons utilizing deadly force must generally cease fire when a threat has been eliminated. To fire a round in such an instance would be a significant liability for the owner of the firearm and the manufacturer of the trigger.

When the user rotates the safety selector assembly 74 to transition from release mode to semi-automatic mode with the trigger 62 pulled, the cam lobe 88 is positioned relative to the cam lobe 94 so the semi-automatic disconnector can rotate forward into position so the hook 60 engages the notch 22 on the hammer before the cam lobe 94 rotates the release disconnector 38 backwards so the hook 48 disengages from the notch 22 on the hammer. Once the safety selector points to the 12 o'clock position, the trigger group for semi-automatic firearms has returned to the position shown in FIG. 6.

As is shown in FIG. 1, the release disconnector 38 and the semi-automatic disconnector 50 differ in subtle ways. First, the release disconnector has a reversed bottom 42 rear 46 profile relative to the semi-automatic disconnector 50. Second, the bottom 42 front 44 of the release disconnector is positioned slightly higher than the bottom 54 front 56 of the semi-automatic disconnector. Third, the forward facing hook 60 of the semi-automatic disconnector extends slightly forward of the forward facing hook 48 of the release disconnector. A release disconnector spring 122 has one end received within a notch 126 in the bottom rear of the release disconnector. A semi-automatic disconnector spring 124 has one end received within a notch 128 in the bottom rear of the semi-automatic disconnector. The springs cause the disconnectors to be biased to rotate counterclockwise about a pin (not labeled) inserted through aperture 130 in the release disconnector and aperture 132 in the semi-automatic disconnector.

While the semi-automatic disconnector 50 and the release disconnector 38 differ in seemingly minor ways, these slight changes in geometry affect what gun designers refer to as the "timing" of the trigger group 10. These changes in geometry are normally used to provide the proper function for a conventional semi-automatic rifle (especially to prevent it from being readily modified) or for full-automatic or select fire machine guns.

Because of the geometry, the semi-automatic disconnector 50 operates to catch the hammer 12 as the hammer is pushed back by the bolt after firing, even while the trigger 62 is still pulled back from a shot. When the trigger is released, the geometry of the semi-automatic disconnector provides that the trigger sear 72 is elevated adequately by the time the hammer swings forward slightly, so the hammer sear surface 24 catches on the sear, readying the trigger for firing.

When the release disconnector 38 is enabled (which occurs in the same manner as enabling the semi-automatic disconnector 50 by the safety selector assembly 74 shifting the release disconnector forward so the release disconnector's forward facing hook 48 can engage the hammer 12) the slightly different timing geometry gives a different result when the trigger 62 is released. Instead of releasing the hammer to the sear 72, the different geometry allows the hammer sear surface 24 to bypass the sear, and the hammer to fly forward to fire a shot. The bolt cocks back the hammer, where the backup disconnector catches the hammer until the trigger is pulled back.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a trigger group for semi-automatic firearms has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although an AR-15 is disclosed, the invention is suitable for use with a wide variety of firearm platforms including the M-16 and AR-10.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A trigger assembly for a firearm comprising:

a frame;

a hammer connected to the frame and movable between a cocked position and a striking position;

the hammer being biased toward the striking position;

a trigger element connected to the frame and movable by a user between a forward position and a rearward position;

a selector connected to the frame and movable between at least a first position and a second position;

a plurality of retention facilities each operable to selectively restrain the hammer in the cocked position, and when the selector is in the first position to enable discharge of the firearm in response to movement of the trigger to the rearward position, and when the selector is in the second position to enable discharge of the firearm in response to movement of the trigger to the forward position after movement to the rearward position.

2. The trigger assembly of claim 1 including a first retention facility and second retention facility operable when the selector is in the first position to release the hammer when the trigger is pulled to the rearward position to discharge the firearm and to retain the hammer in the rearward position while the trigger remains in the rearward position after discharge of the firearm and after the trigger is returned to the forward position.

3. The trigger assembly of claim 2 including a third retention facility and fourth retention facility operable when the selector is in the second position to restrain the hammer in the cocked position when the trigger is moved to the rearward position, to release the hammer to discharge the firearm when the trigger is moved to the forward position after the trigger is pulled to the rearward position, and to restrain the hammer in the cocked position after discharge of the firearm.

4. The trigger assembly of claim 3 wherein the frame includes a cam surface, and at least one of the first, second, third, and fourth retention facilities has a cam follower adapted to follow the cam surface and generate a movement of the at least one of the first, second, third, and fourth retention facilities to cease restraint of the hammer by the at least one of the first, second, third, and fourth retention facilities.

5. The trigger assembly of claim 3 wherein when the selector is in the second position, the third retention facility is operable to restrain the hammer in the cocked position, and to release the hammer to restraint by the fourth retention facility in response to moving the trigger to the rearward position.

6. The trigger assembly of claim 3 wherein at least one of the first and second retention facilities and at least one of the third and fourth retention facilities comprise a set of adjacent retention facilities operable to engage adjacent portions of a common portion of the hammer.

7. The trigger assembly of claim 6 wherein adjacent retention facilities are each planar elements parallel to and adjacent to each other.

8. The trigger assembly of claim 1 wherein the selector includes a block element operable to prevent movement of the selector from the first position to the second position while the hammer is being restrained by any of the retention facilities.

9. The trigger assembly of claim 8 wherein the block element is interoperable in response to depression of the hammer by a bolt carrier to separate the hammer from all retention facilities, the hammer operable to move at least one of the retention facilities away from the block element to enable movement of the selector from the first position to the second position.

10. A trigger group for a firearm comprising:

a frame;

a hammer connected to the frame and movable between a cocked position and a striking position;

the hammer being biased toward the striking position;

a trigger element connected to the frame and movable by a user between a forward position and a rearward position;

a selector connected to the frame and movable between at least a first position and a second position;

a movable first hammer retention facility responsive to movement of the trigger element;

when selector is in the first position, the trigger element is in the forward position, and the hammer is in the cocked position, the first hammer retention facility being operable to engage the hammer to restrain the hammer in the cocked position, and in response to pulling the trigger element to the rearward position to release the hammer to the striking position to discharge the firearm;

a disconnector assembly connected to the frame and operably connected to the selector and having a second hammer retention facility operable when the selector is in the first position to restrain the hammer in the cocked position after discharge of the firearm while the trigger is maintained in the rearward position;

the disconnector assembly having a third hammer retention facility operable when the selector is in the second position to restrain the hammer in the cocked position; and the disconnector assembly having a fourth hammer retention facility operable when the selector is in the second position to restrain the hammer in the cocked position in response to movement of the trigger to the rearward position, and in response to movement of the trigger element to the forward position to release the hammer to the striking position to discharge the firearm.

11. The trigger group of claim 10 wherein the frame includes a cam surface, and at least one of the first, second, third, and fourth retention facilities has a cam follower adapted to follow the cam surface and generate a movement of the at least one of the first, second, third, and fourth retention facilities to cease restraint of the hammer by the at least one of the first, second, third, and fourth retention facilities.

12. The trigger group of claim 10 wherein the frame includes a cam surface, and the third retention facility has a cam follower adapted to follow the cam surface and generate a movement of the third retention facility to cease restraint of the hammer by the third retention facility.

13. The trigger group of claim 10 wherein when the selector is in the second position, the third retention facility is operable to restrain the hammer in the cocked position, and to release the hammer to restraint by the fourth retention facility in response to moving the trigger to the rearward position.

14. The trigger group of claim 10 wherein the second retention facility and the fourth retention facility comprise a set of adjacent retention facilities operable to engage adjacent portions of a common portion of the hammer.

15. The trigger group of claim 14 wherein the adjacent retention facilities are each planar elements parallel to and adjacent to each other.

16. The trigger group of claim 10 wherein the selector includes a block element operable to prevent movement of the selector from the first position to the second position while the hammer is being restrained by any of the retention facilities.

17. The trigger group of claim 16 wherein the block element is interoperable in response to depression of the hammer by a bolt carrier to separate the hammer from all retention facilities, the hammer operable to move at least one of the retention facilities away from the block element to enable movement of the selector from the first position to the second position.

18. The trigger group of claim 10 wherein the selector has a third position in which discharge of the firearm is prevented.

* * * * *